US006371208B1

(12) United States Patent
Norman et al.

(10) Patent No.: US 6,371,208 B1
(45) Date of Patent: Apr. 16, 2002

(54) VARIABLE DOWNHOLE CHOKE

(75) Inventors: Dale Norman, Spring; Robert S. O'Brien, Katy; Ronnie D. Russell, Dickinson, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/598,130

(22) Filed: Jun. 21, 2000

Related U.S. Application Data

(60) Provisional application No. 60/140,879, filed on Jun. 24, 1999.

(51) Int. Cl.[7] ..... E21B 34/06
(52) U.S. Cl. ..... 166/334.4; 166/91
(58) Field of Search ..... 166/91.1, 334.1, 166/334.4; 251/120, 121, 122; 138/45, 46

(56) References Cited

U.S. PATENT DOCUMENTS 2,663,307 A * 12/1953 Birdwell ..... 166/334.4
5,018,703 A * 5/1991 Goode ..... 251/127
5,445,361 A 8/1995 Hellman, Sr. ..... 251/205
5,979,558 A 11/1999 Bouldin et al. ..... 166/363
6,112,816 A * 9/2000 Orzechowski et al. ... 166/334.4
6,260,616 B1 * 7/2001 Carmody et al. ..... 166/332.4

FOREIGN PATENT DOCUMENTS

EP 0 893 574 A2 1/1999
WO WO 99/05387 2/1999

* cited by examiner

*Primary Examiner*—William Neuder
(74) *Attorney, Agent, or Firm*—Cantor Colburn LLP

(57) ABSTRACT

A variable downhole choke is disclosed wherein an outer housing includes a selected port pattern of ports and subports and a sleeve having similar ports and subports wherein subports depend from ports on each of the housing and sleeve. The ports/subports are oriented so that upon converging movement of housing and sleeve the sleeve subports align with housing subports before the sleeve ports align with housing ports.

24 Claims, 7 Drawing Sheets

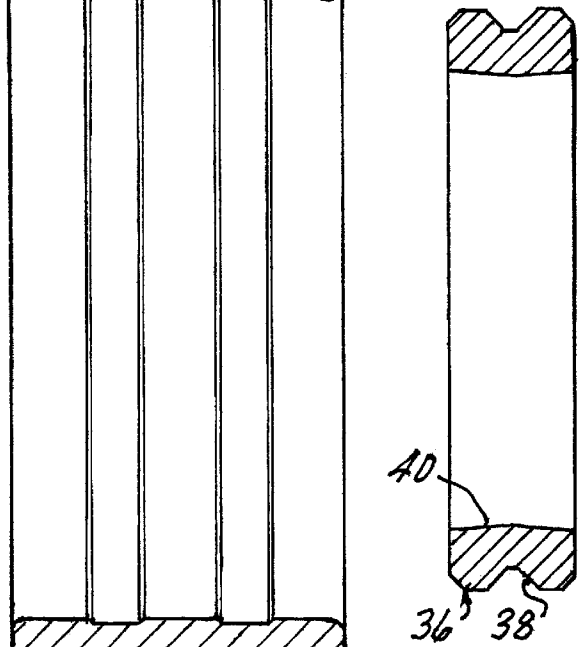
FIG. 10
FIG. 11
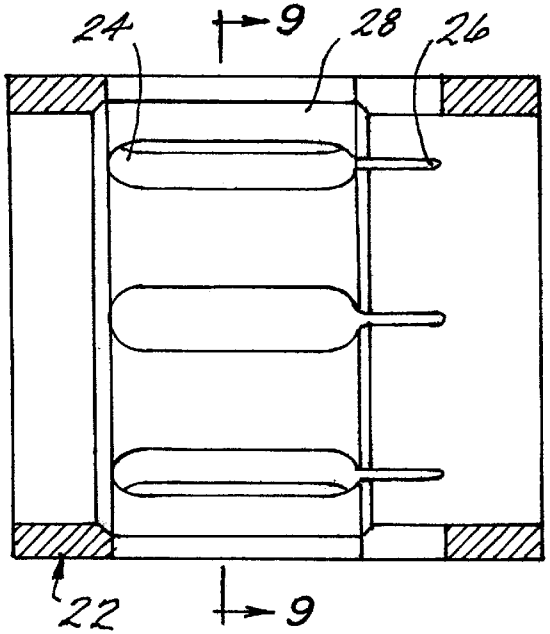
FIG. 8
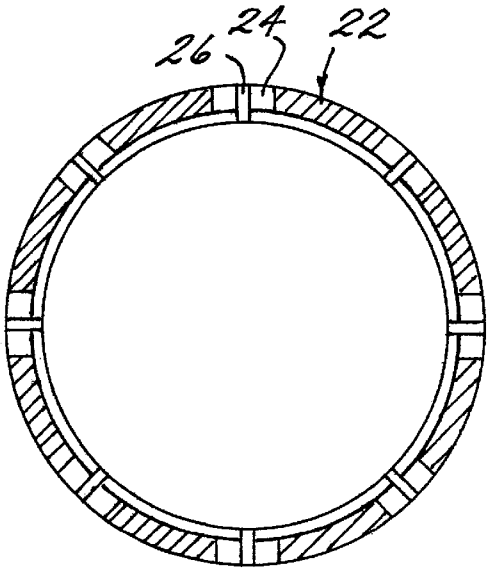
FIG. 9

VARIABLE DOWNHOLE CHOKE

CROSS-REFERENCE TO RELATED APPLICATIONS

This application claims the benefit of U.S. Provisional Application Ser. No. 60/140,879 filed Jun. 24, 1999, which is incorporated herein by reference.

BACKGROUND OF THE INVENTION

1. Field of the Invention

The invention relates to oil field tools. More particularly, the invention relates to downhole tools providing variable choking capability.

2. Prior Art

Oil wells can be productive to the point of over productiveness when the flow is not controlled downhole. Oil and gas in underground/under sea reservoirs are at extremely high pressure and can be all too willing to be expressed from these reservoirs. As one of skill in the art is painfully aware, this condition is hazardous and must avoided.

In order to prevent the outflow of oil or gas at a rate greater than can be accommodated at the surface and to control production of unwanted fluids, many systems have traditionally been employed. One of the tools that is used both to control the rate of expulsion of hydrocarbons from the reservoir and in some cases to limit the penetration into the well of undesired fluids is a choke. Chokes conventionally employ inner and outer sleeves having alignable and misalignable ports that are of the same size and shape. In these systems the degree of alignment of ports regulates the speed of the flow, thus how choked the system is. A drawback of such system is that erosion characteristics tend to make the system cost prohibitive.

SUMMARY OF THE INVENTION

A variable choke as disclosed herein employs, in the broadest sense, a choke housing and choke insert which are variably positionable relative to one another to align and misalign, to varying degrees, sets of ports in the housing and insert. Specially shaped and oriented ports provide for pressure equalization and choking capabilities while minimizing erosion of the components of the choke. In particular, a preferred port shape comprises a port and a subport depending therefrom. The subport is of smaller area than the port and preferably is elongated. An elongated subport reduces erosion of the subport itself when subject to flowing fluid because of fluid dynamics which cause the stream to become thinner than the actual dimension of the subport. Thus while fluid passes through the subport at high velocity the shape of the subport and its construction from an erosion resistant material, help to minimize erosion.

A further feature of the choke is that a seal stack is not subject directly to flowing fluid thus providing a longer life.

Finally, with respect to pressure equalization, the choke is resistant to the deleterious effects of equalization of a large pressure differential by incorporating at least one and preferably two diffuser rings to restrict flow and introduce turbulence which reduces flow velocity. These cooperate to allow the choke to effectively equalize a pressure differential.

BRIEF DESCRIPTION OF THE DRAWINGS

Referring now to the drawings wherein like elements are numbered alike in the several FIGURES:

FIG. 8 is a longitudinal cross-sectional view of a housing sleeve;

FIG. 9 is a cross-sectional view of the housing sleeve of FIG. 8 taken along section line 9—9 in FIG. 8;

FIG. 10 is a longitudinal cross-section of a first diffuser ring;

FIG. 11 is a longitudinal cross-section of a second diffuser ring;

DETAILED DESCRIPTION OF THE PREFERRED EMBODIMENTS

A preferred embodiment of the variable choke is illustrated in several different operating positions in FIGS. 1–6. Each of the components are identified while referring to FIG. 1, these components being illustrated in different positions in FIGS. 2–6 to convey the various operating positions of the choke. Individual components and alternative components are illustrated and further discussed to the extent necessary with reference to FIGS. 7–20. As will be appreciated by one of skill in the art, the left side of a figure is intended to be the uphole side of the device with the right side being more downhole. It should be understood however that components discussed as downhole or uphole could be reversed with similar results providing the concepts of the variable choke are maintained.

Figure 1:
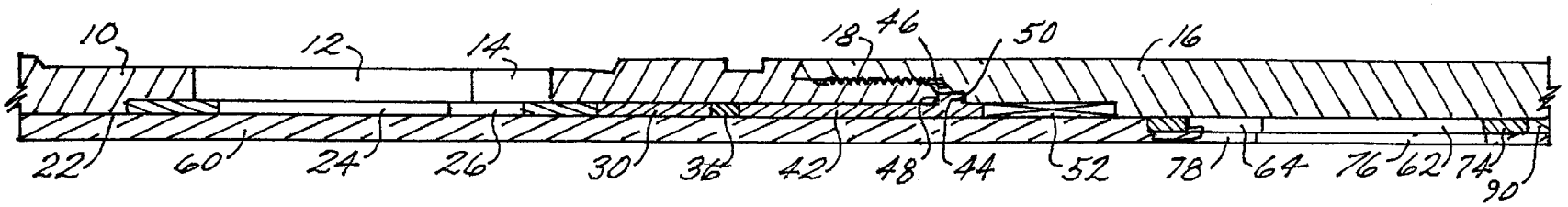
FIG. 1 is a quarter section view of a variable choke embodiment as disclosed herein in a closed position.
Figure 2:
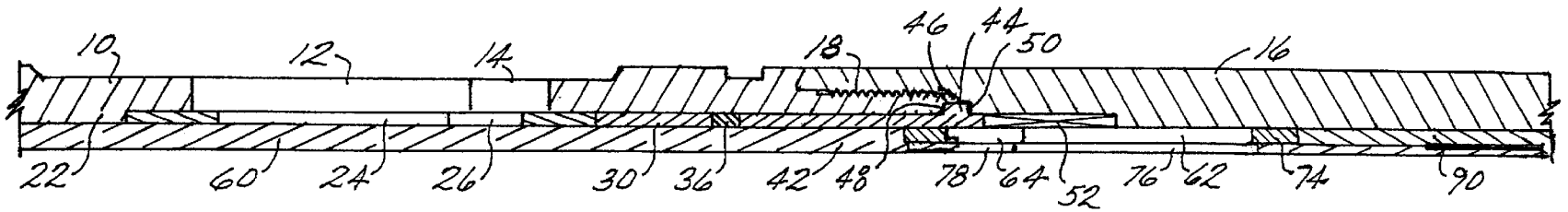
FIG. 2 is a quarter section view of the choke embodiment of FIG. 1 in an initial equalizing position.

Referring to FIG. 1, a choke housing 10 is preferably formed from a durable material such as steel. Housing 10 is provided with at least one and preferably a plurality of port/subport combinations identified as ports 12 and subports 14. Housing 10 and a lower sub 16 are threadable together (or otherwise attached) at thread 18 and together house all other components of the variable choke. Housing 10 as noted is provided with port/subport combinations whose shape is better ascertainable in FIG. 7. The inventors hereof prefer the complex port/subport configuration because of benefits realized with respect to pressure differential control and erosion resistance. The housing ports/subports 12, 14 have counterpart port/subport combinations on a choke insert described more fully hereunder.

Figure 7:
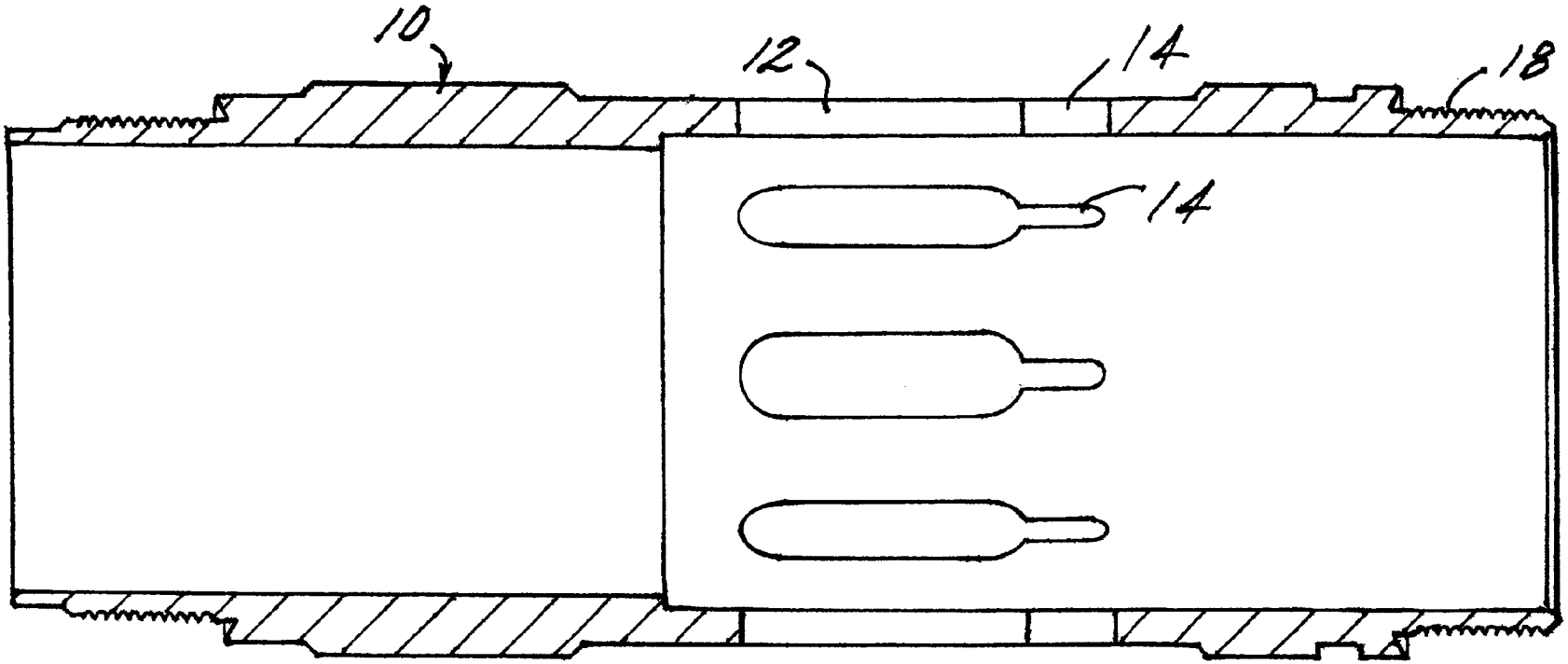
FIG. 7 is a longitudinal cross-sectional view of a choke housing.

Still referring to FIGS. 1 and 7, housing 10 preferably is milled to include a larger I.D. 20 on part of the housing to receive an erosion resistant sleeve 22. Sleeve 22 is illustrated independently in FIGS. 8 and 9. Sleeve 22 is constructible of any erosion resistant material, ceramic or tungsten carbide material being preferred. The sleeve 22 may also be constructible of another material and coated with an erosion resistant material. Sleeve 22 may be mounted in a number of ways (known to the art) in housing 10 such as but not limited to epoxy, shrink fitting, press fitting, etc. It should also be appreciated that the housing could be constructed of a single piece of material which either is or is coated with an erosion resistant material such as ceramic or tungsten carbide.

Sleeve 22 is not intended to move relative to housing 10 once installed therein and thus has specific port/subport shape and locations to complement the housing 10. Ports 24 and subports 26, well shown in FIG. 8, are clearly similar in configuration to housing ports/subports 12, 14, however it is noted that the overall length of the combination, and indeed the length of each port and subport individually is shorter than that of housing ports 12 and subports 14. This arrangement protects the metal housing from erosion by directing the most erosional flow to impact the sleeve 22 which as stated preferably comprises an erosion resistant material.

It is further noted from FIG. 8 that sleeve 22 is enlarged in I.D. in the area 28 corresponding to ports 24. This enhances operation of the variable choke by facilitating circumferential flow of fluid.

Adjacent sleeve 22 in the downhole direction, referring again to FIG. 1 is an annular first diffuser ring 30 preferably constructed of an erosion resistant material. In a preferred embodiment, diffuser ring 30 is of a ceramic tungsten carbide material. Referring to FIG. 10, the I.D. of diffuser ring 30 is illustrated to have preferably a pair of circumferential grooves 32 therein. Grooves 32 need only be shallow grooves in surface 34 of ring 30 to cause turbulence to occur in fluid flowing between surface 34 and an insert discussed hereunder. In a preferred embodiment, the clearance between surface 34 and the insert is on the order of about a few thousandths of an inch. Further, there is a clearance at the O.D. of ring 30 of about a few thousandths of an inch.

Moving downhole from first diffuser ring 30 a second diffuser ring 36 is disposed in the same annulus as first diffuser ring 30. It will be noted that the second diffuser ring 36, referring to FIG. 11, is provided with a groove 38 on its O.D. but that its I.D. 40 is smooth. It is preferable that I.D. 40 of second diffuser ring 36 is of a tolerance with respect to the insert (discussed hereunder) that is tighter than that of diffuser ring 30 so that flow of fluid is caused to migrate radially between first ring 30 and second ring 36 and then to travel axially again on the O.D. of second ring 36. The second diffuser ring 36 slides within the annulus in the direction of fluid flow to help further restrict flow as it contacts an adjacent part (production-spacer; injection-first diffuser ring). This is a tortuous path for the fluid and creates additional turbulence while reducing velocity further.

Referring again to FIG. 1, first diffuser ring 30 and second diffuser ring 36 are located in housing 10 by spacer 42 which includes an annular flange 44 received in a recess 46 formed by the convergence of downhole end 48 of housing 10 and shoulder 50 of lower sub 16. Upon assembly of housing 10 and lower sub 16 with the above discussed components therein, movement of spacer 42 is restricted by annular flange 44 which assists in retaining first ring 30 and second ring 36.

Figure 12:
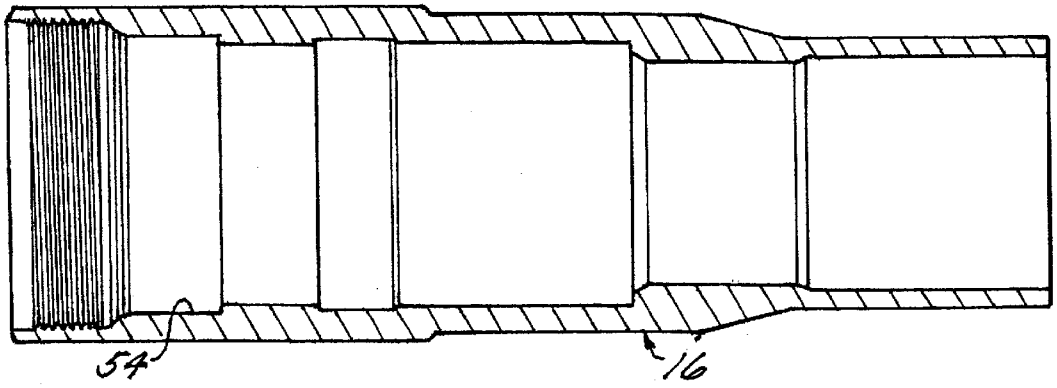
FIG. 12 is a longitudinal cross-section of a lower sub of the variable choke.

A secondary function of spacer 42 is to provide a stop for seal stack 52. Seal stack 52 is preferably a non-elastomeric chevron seal stack although other seal types are possible, as known to the art. Seal stack 52 is located in lower sub 16 in recess 54 therein which is illustrated in FIGS. 1 and 12.

Radially inwardly of all components thus far discussed is a choke insert which can be in multiple components or a single component as desired.

Figure 14:
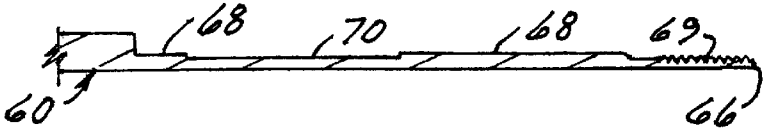
FIG. 14 is a detail view taken along line 14—14.
Figure 13:
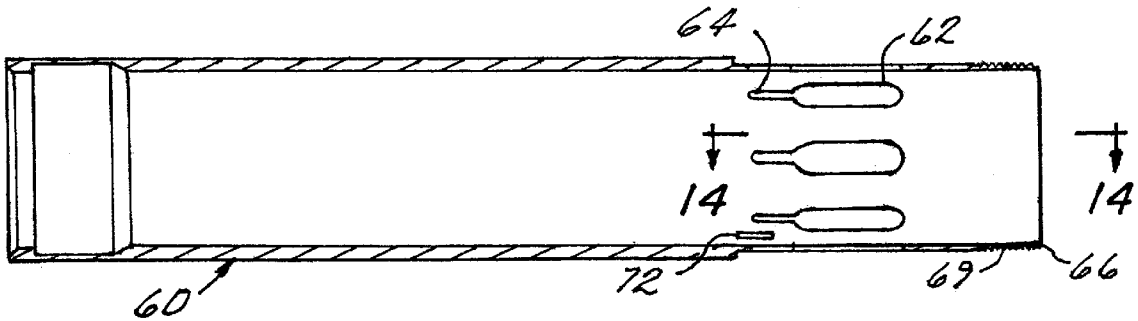
FIG. 13 is a long cross-sectional of a first portion of a choke insert.
Figure 16:
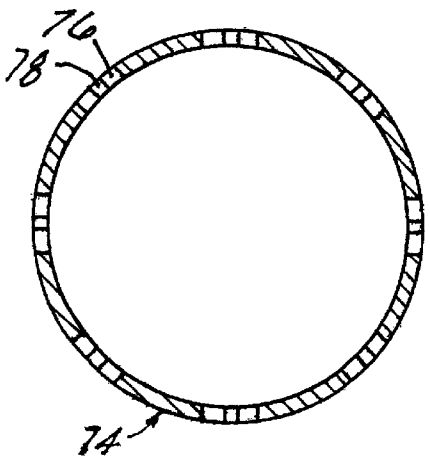
FIG. 16 is a cross-sectional view of the sleeve of FIG. 15 taken along section line 16—16.
Figure 15:
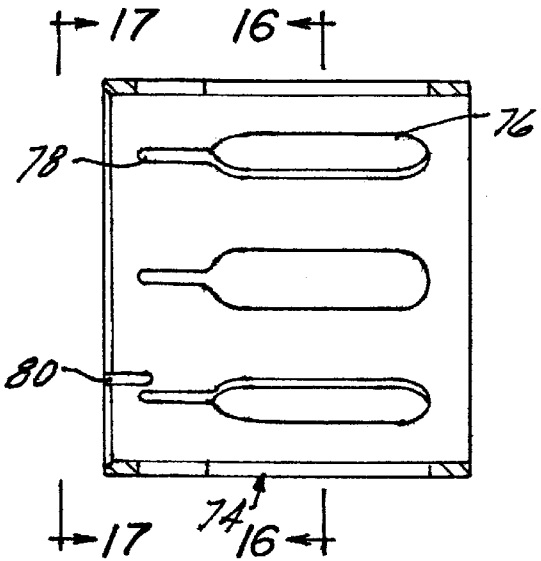
FIG. 15 is a long cross-sectional of an insert sleeve embodiment of the choke.
Figure 18:
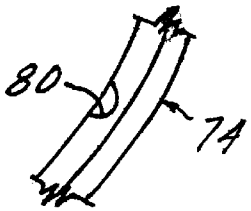
FIG. 18 is a detail view of the sleeve from FIG. 17 defined by circumscription 18 in FIG. 17.
Figure 17:
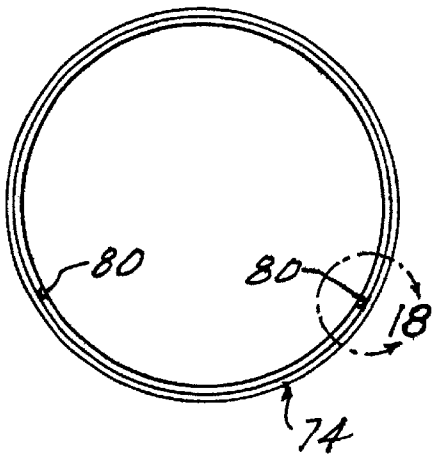
FIG. 17 is an end view of the sleeve of FIG. 15 taken along line 17—17.

Referring to FIGS. 1, 13 and 14, a first portion of one embodiment of an insert is illustrated. The first portion 60 of the insert is preferably formed of metal and includes ports 62 and subports 64 which are similar in configuration to sleeve 22 ports 24/subports 26 but are oriented oppositely such that upon movement of the insert axially to converge the ports/subports of housing and insert, the subports 64 will communicate with subports 26 first. Other features of first portion 60 are appreciated from FIG. 14. More specifically, FIG. 14 is a detail view of a downhole end 66 of portion 60. FIG. 14 illustrates areas 68 that have a larger O.D. and area 70 having a smaller O.D. Area 70 is provided to allow more epoxy to act on the surface of portion 60 and an erosion resistant insert sleeve 74 to better retain that sleeve. At the downhole end 66 of portion 60, preferably a thread 69 is located. Finally portion 60 includes pin receptacle 72 to receive a pin, (not shown) which locates the insert sleeve 74 (FIGS. 1, 15–18) on portion 60 and prevents rotation thereon.

Insert sleeve 74 includes port 76/subport 78 combinations to substantially match first portion 60 ports 62/subports 64 and is configured to fit over portion 60 to be secured thereto as above noted. It is important to note that in a preferred embodiment, the insert sleeve ports 76/subports 78 are the same shape as the ports 62/subports 64 in the first portion 60, similar to the housing sleeve 22, to protect the portion 60 from erosion. Insert sleeve 74 is an erosion resistant material, preferably a ceramic tungsten carbide material, and further includes recess 80 (FIGS. 15 and 18) to receive a pin (not shown) preventing rotation relative to the first portion 60. Recess 80 receives the same pin that communicates with pin receptacle 72.

Figure 19:
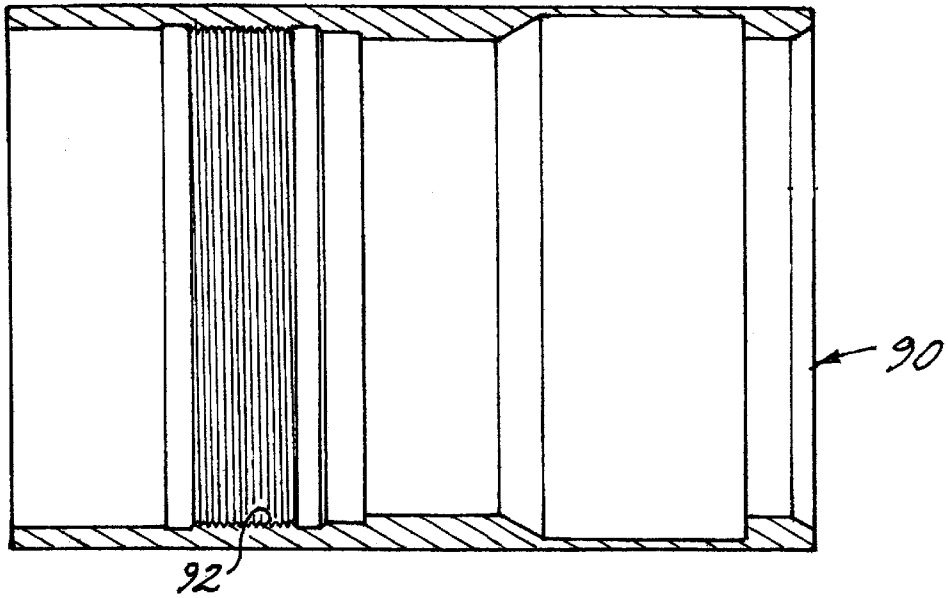
FIG. 19 is a long cross-sectional view of a second portion of an insert embodiment of the choke.

Referring to FIGS. 1 and 19, a second portion 90 of the insert is illustrated. The second portion 90 includes preferably a thread 92 to communicate with thread 69 to bind first portion 60 with second portion 90 thereby axially retaining choke insert sleeve 74.

Figure 20:
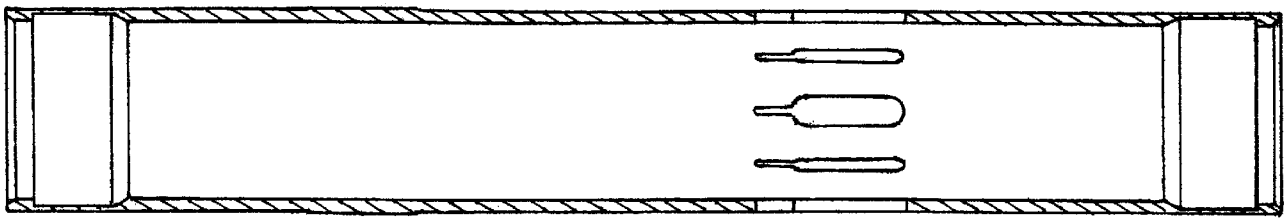
FIG. 20 is a long cross-sectional of a single piece alternate embodiment of the insert of the choke.

Referring to FIG. 20 it is important to note that the choke insert can also be constructed in a single piece and be coated with an erosion resistant material. A perusal of the figure in connection with the foregoing will provide one of ordinary skill an understanding of the embodiment.

Moving back to focus on operation of the tool and referring to FIGS. 1–6, FIG. 1 illustrates the tool in the closed position with ports 62/subports 64 and ports 76/subports 78 fully sealed off to fluid flow by seal stack 52. Moving to FIG. 2, the pressure equalization process is initiated by shifting of the insert, referred to at this point as 100 for simplicity, one of ordinary skill in the art being expected to realize that 100 is made of up first portion 60, second portion 90 and insert sleeve 74 or a single piece as in FIG. 20, until subports 64, 78 are just uphole of seal stack 52. Fluid from the annulus will move through the tortuous path around the first and second diffuser rings 30, 36 and along spacer 42 to access subports 64, 78. The reverse is true for an injection situation. This is an initial equalizing position.

Figure 3:
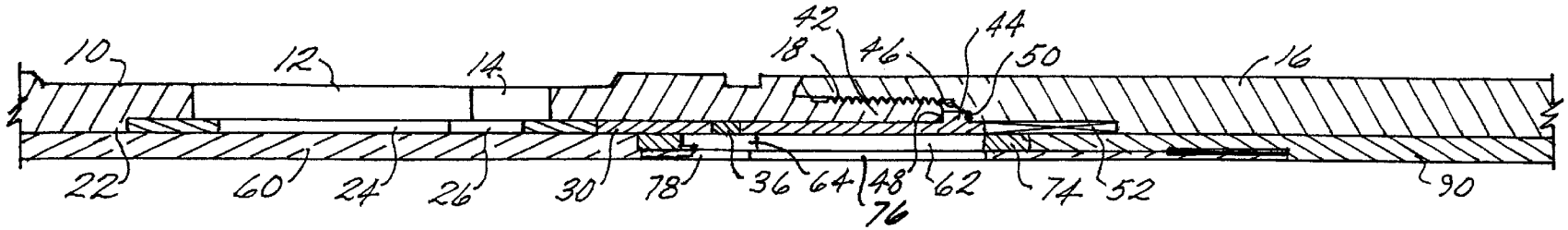
FIG. 3 is a quarter section view of the choke embodiment of FIG. 1 in a fully equalizing position.

Referring to FIG. 3, the ports 62, 76 and subports 64, 78 have been shifted to be entirely out from under seal stack 52 which is the full equalizing position. More fluid can pass in this position because the fluid need pass through less of the tortuous path of the diffuser rings 30, 36 and spacer 42.

Figure 4:
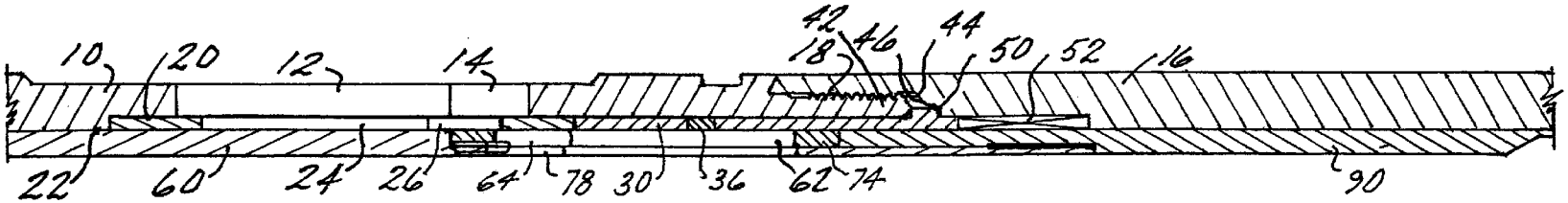
FIG. 4 is a quarter section view of the choke embodiment of FIG. 1 in a fully choked position.

In FIG. 4 the device is illustrated in the fully choked position where subports 64, 78 have not yet overlapped subports 14, 26 but are positioned closely thereto.

Figure 5:
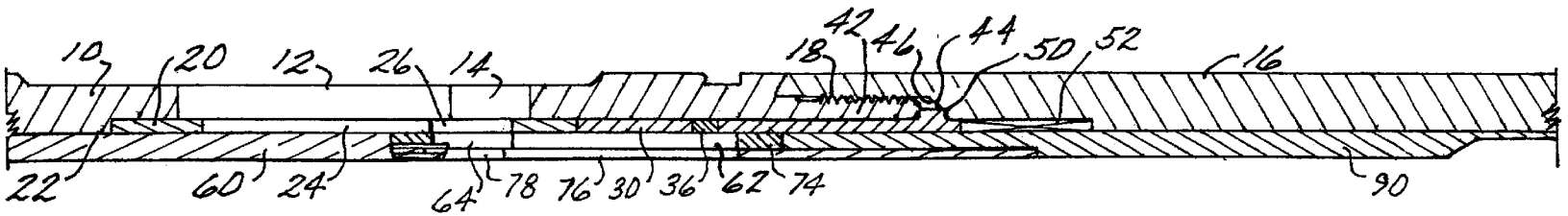
FIG. 5 is a quarter section view of the choke embodiment of FIG. 1 in a partially choked position.

In FIG. 5 the device is illustrated in the partially choked position where there is some overlap of subports 64, 78 and subports 14, 26. Fluid can move rapidly through the subports and the erosion resistant character of the material thereof is important.

Figure 6:
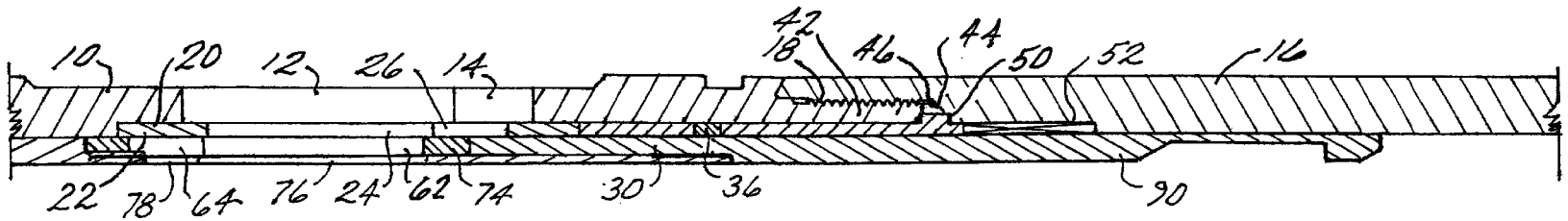
FIG. 6 is a quarter section view of the choke embodiment of FIG. 1 in a fully open position.

In FIG. 6 the tool is in its fully open position where the ports 62, 76 are aligned with ports 12, 24. It will be noted in this view that the ceramic tungsten carbide portions extend into the ports/subports more than the metal areas to reduce erosion.

While preferred embodiments have been shown and described, various modifications and substitutions may be made thereto without departing from the spirit and scope of the invention. Accordingly, it is to be understood that the present invention has been described by way of illustration and not limitation.

What is claimed:

1. A variable downhole choke comprising:

a choke insert having at least one choke insert port and choke insert subport forming a port/subport combination wherein the choke insert subport depends from the choke insert port; and a choke housing having at least one choke housing port and housing subport forming a port/subport combination wherein the housing subport depends from the housing port and wherein the choke insert port/subport combination orients the choke insert subport toward the housing subport of the housing port/subport combination such that upon relative movement of the choke housing and choke insert, the choke housing subport and choke insert subport align prior to the choke housing port and choke insert port.

2. A variable downhole choke as claimed in claim 1 wherein said choke housing includes at least one erosion resistant port/subport combination sleeve.

3. A variable downhole choke as claimed in claim 2 wherein said at least one sleeve is ceramic.

4. A variable downhole choke as claimed in claim 2 wherein said at least one sleeve is tungsten carbide.

5. A variable downhole choke as claimed in claim 1 wherein said choke insert includes an erosion resistant insert sleeve.

6. A variable downhole choke as claimed in claim 5 wherein said insert sleeve is ceramic.

7. A variable downhole choke as claimed in claim 5 wherein said insert sleeve is tungsten carbide.

8. A variable downhole choke as claimed in claim 1 wherein said choke insert includes an erosion resistant material.

9. A variable downhole choke as claimed in claim 8 wherein said erosion resistant material is ceramic.

10. A variable downhole choke as claimed in claim 8 wherein said erosion resistant material is tungsten carbide.

11. A variable downhole choke as claimed in claim 1 wherein said at least one subport on each of said choke housing and said choke insert are of a shape selected to reduce erosion thereof.

12. A variable downhole choke as claimed in claim 1 wherein said choke includes at least one diffuser ring positioned to reduce high velocity fluid flow.

13. A variable downhole choke as claimed in claim 12 wherein said at least one diffuser ring includes at least one groove on an I.D. thereof.

14. A variable downhole choke as claimed in claim 12 wherein said at least one diffuser ring is constructed of an erosion resistant material.

15. A variable downhole choke as claimed in claim 14 wherein said material is ceramic.

16. A variable downhole choke as claimed in claim 1 wherein said insert comprises a single piece of erosion resistant material.

17. A variable downhole choke as claimed in claim 1 wherein said choke insert comprises:

a first portion;

a second portion attachable to said first portion; and an erosion resistant sleeve sandwichable between said first portion and said second portion.

18. A variable downhole choke as claimed in claim 1 wherein said choke further includes at least one diffuser ring.

19. A variable downhole choke as claimed in claim 1 wherein said choke insert comprises:

a first portion having larger diameter section and a smaller diameter section; and an erosion resistant sleeve disposable upon said smaller diameter section.

20. A variable downhole choke comprising:

a choke housing having at least one port and at least one subport depending from said port;

an erosion resistant sleeve disposed within said housing and having a port and subport configuration substantially matching said housing;

a choke insert slideably disposed within said choke housing and having at least one choke insert port and at least one insert subport depending from said choke insert port, said choke insert subport being located relative to said choke insert port to, upon axial movement of said choke insert resulting in converging movement of said choke housing port and said choke insert port, ensure alignment of said choke insert subport with said choke housing subport prior to alignment of said choke insert port with said choke housing port.

21. A variable downhole choke as claimed in claim, 20 wherein said choke insert comprises a single piece erosion resistant construction.

22. A variable downhole choke as claimed in claim 20 wherein said choke insert comprises:

a first portion;

a second portion attachable to said first portion; and an erosion resistant sleeve sandwichable between said first portion and said second portion.

23. A variable downhole choke as claimed in claim 20 wherein said choke further includes at least one diffuser ring.

24. A variable downhole choke as claimed in claim 20 wherein said choke insert comprises:

a first portion having larger diameter section and a smaller diameter section; and an erosion resistant sleeve disposable upon said smaller diameter section.

* * * * *